United States Patent [19]

Yonezawa

[11] Patent Number: 5,044,400

[45] Date of Patent: Sep. 3, 1991

[54] CONTROL VALVE ASSEMBLY FOR PRESSURIZED OIL

[75] Inventor: Keitaro Yonezawa, Nishi, Japan

[73] Assignee: Kabushiki Kaisha Kosmek, Japan

[21] Appl. No.: 554,900

[22] Filed: Jul. 20, 1990

[30] Foreign Application Priority Data

Aug. 9, 1989 [JP] Japan ..... 1-207673

[51] Int. Cl.[5] ..... F15B 13/042

[52] U.S. Cl. ..... 137/596.18; 91/446; 91/448; 137/596.2

[58] Field of Search ..... 91/446, 448; 137/596.18, 596.2

[56] References Cited

U.S. PATENT DOCUMENTS 3,934,610 1/1976 Solie ..... 137/596.2 X

*Primary Examiner*—Gerald A. Michalsky

*Attorney, Agent, or Firm*—Bacon & Thomas

[57] ABSTRACT

A control valve assembly for a pressurized oil has a valve chamber (4) within which a pressure supply valve seat (15), a first chamber (11), a short-circuit prevention valve seat (17), a second chamber (12) and a return valve seat (16) are arranged in order. A check valve member (19) inserted into the first chamber (11) is adapted to be resiliently urged to the pressure supply valve seat (15) for valve closing by means of a valve closing spring (19) through a resilient sealing member (21). A return valve member (22) and a short-circuit prevention valve member (23) are inserted into the second chamber (12) in series. The return valve member (22) is adapted to be resiliently urged to the return valve seat (16) for valve closing by means of another valve closing spring (30). Under a pressure released condition in which the return operation means (37) is operated, the short-circuit prevention valve member (23) is adapted to be actuated toward the short-circuit prevention valve seat (17) for valve closing by a valve opening member (43) through the return valve member (22).

15 Claims, 5 Drawing Sheets

CONTROL VALVE ASSEMBLY FOR PRESSURIZED OIL

BACKGROUND OF THE INVENTION

1. Field of the invention

The present invention relates to a control valve assembly adapted to be used for supplying and discharging a pressurized oil to and from a single acting hydraulic cylinder, and more specifically to a control valve assembly of the type adapted to prevent a leakage of a pressurized oil between a valve member and a valve seat by employing a poppet valve as valve members to be inserted into a valve chamber.

2. Prior Art

The present invention resides in an improvement of a control valve assembly of the type described in Japanese Patent Publication No. 1989-31067 (referred to as the first conventional embodiment hereinafter) or in Japanese Laid Open Patent Publication 1983-170906 (referred to as the second conventional embodiment hereinafter).

These first and second conventional embodiments were previously proposed by the inventor of the present invention. The basic construction thereof is as follows as shown in FIG. 7 (for the first conventional embodiment) or in FIG. 8 (for the second conventional embodiment).

In a valve chamber 104, 204 of a valve assembly 101, 201 there are provided a pressure supply port P opened on the upper end side as the first end side thereof, a return port R opened on the lower end side as the second end side thereof and a working port A opened at a position out of both those ports P, R respectively.

A pressure supply valve seat 115, 215 is formed at the outer peripheral portion of the pressure supply port P, and a return valve seat 116, 216 is formed at the outer peripheral portion of the return port R. A check valve member 119, 219 is resiliently urged to the pressure supply valve seat 115, 215 by means of a check valve member closing spring 120, 220. A return valve member 122, 222 is resiliently urged to the return valve seat 116, 216 by means of a return valve member closing spring 130, 230.

A return operation means 137, 237 is disposed outside the lower end portion of the valve chamber 104, 204, and a valve opening member 143, 243 is disposed opposedly to the return valve member 122, 222 from the side of the return port R.

The aforementioned valve assembly 101, 201 operates as follows.

In the case that the return operation means 137, 237 is not operated, firstly the return valve member 122, 222 is brought into contact with the return valve seat 116, 216 for valve closing by means of a resultant force obtained from a resilient force of the return valve member closing spring 130, 230 and an interior pressure of the valve chamber 104, 204, and the pressurized oil within the pressure supply port P pushes and opens the check valve member 119, 219 so as to be supplied to the valve chamber 104, 204 and the working port A and to provide a pressure supplied condition for the valve assembly. Subsequently, when the interior pressure within the valve chamber 104, 204 reaches a predetermined pressure, the check valve member 119, 219 is brought into contact with the pressure supply valve seat 115, 215 for valve closing by means of a resilient force of the check valve member closing spring 120, 220 so as to provide a pressure keeping condition for the valve assembly.

Under the aforementioned pressure keeping condition, when the return operation means 137, 237 is operated, the valve opening member 143, 243 is advanced upward so that the return valve member 122, 222 can be pushed and opened by means of the leading end portion of the valve opening member 143, 243. Thereby, the pressurized oils within the working port A and the valve chamber 104, 204 are discharged to the return port R.

In the above-mentioned basic construction, the first and second conventional embodiments have the following construction for assembling the check valve member 119, 219 and the return valve member 122, 222 within the valve chamber 104, 204.

Construction of First Conventional Embodiment: refer to FIG. 7.

The check valve member 119 and the return valve member 122 are inserted into the valve chamber 104 composed of one chamber, on the upside and on the downside respectively. The check valve member closing spring 120 and the return valve member closing spring 130 are formed as one valve closing spring mounted between both the valve members 119, 122. A resilient sealing member 121 is interposed between the check valve member 119 and the pressure supply valve seat 115. When the return operation means 137 is operated, the resilient sealing member 121 of the check valve member 119 is brought into contact with the pressure supplying valve seat 115 for valve closing by means of the valve opening member 143 through the return valve member 122 so that the pressurized oil within the pressure supply port P can be prevented from leaking into the valve chamber 104.

Construction of Second Conventional Embodiment: refer to FIG. 8.

In this embodiment, the check valve member 219, a movable spring receptacle 218 and the return valve member 222 are inserted in order into the valve chamber 204 composed of one chamber similarly to the aforementioned first conventional embodiment. The check valve member closing spring 220 is mounted between the check valve member 219 and the movable spring receptacle 218. The return valve member closing spring 230 is mounted between the movable spring receptacle 218 and the return valve member 222. The check valve member 219 and the pressure supply valve seat 215 both of which are made of a hard sealing material are brought into direct contact with each other for valve closing. When the return operation means 237 is operated, the check valve member 219 is brought into contact, namely metal-to-metal contact with the pressure supplying valve seat 215 by means of the valve opening member 243 through the return valve member 222 and the movable spring receptacle 218 in order so that the pressurized oil within the pressure supply port P can be prevented from leaking into the valve chamber 204.

There are following problems associated with the aforementioned respective conventional embodiments.

Problems of First Conventional Embodiment: refer to FIG. 7.

Under the pressure released condition having actuated the return operation means 137, the resilient sealing member 121 of the check valve member 119 is strongly compressed against the pressure supply valve seat 115 by means of a pressing force of the valve opening member 143. Therefore, when the number of returning operations is accumulated, the resilient sealing member 121 is apt to cause a plastic deformation which shortens its service life.

By the way, in the case that the return operation means 137 is of a pneumatic type as shown in the figure, the service life of the resilient sealing member 121 is further shortened due to the following reasons.

Generally, a pressurized air supplied from a pressurized air supply line to a pneumatic actuation chamber 140 of the return operation means 137 reaches a predetermined pressure with repeating a pressure pulsation caused by a flow resistance of the pressurized air supply line and an inertia effect. Therefore, during the pressure rising of every pressure pulsation a received pressure of a pneumatic piston 139 surpasses a pressure received thereby from the pressure supply port P so as to close the check valve member 119. On the other hand, during the pressure lowering of the pressure pulsation the pressure received by the pneumatic piston 139 from the pressure supply port P surpasses the received pressure thereof so as to open the check valve member 119. These valve closing operations and the valve opening operations are repeated. During the valve closing operation of the check valve member 119, since the pressurized oil flows at an ultrahigh speed through a narrow flow passage between the pressure supply valve seat 115 and the valve surface of the check valve member 119 just before the valve surface is brought into contact with the pressure supply valve seat 115 for valve closing, the resilient sealing member 121 is cut out and the service life thereof is extremely shortened.

Problems of Second Conventional Embodiment: Refer to FIG. 8.

Advantageously this embodiment is able to solve the problems of the aforementioned first conventional embodiment by such a construction as bringing both the check valve member 219 and the pressure supply valve seat 215 made of a hard material into direct contact, namely metal-to-metal contact with each other for valve closing, but it is accompanied with following other problems.

During the pressure keeping condition in which both the valve members 219, 222 are closed by the pressure within the valve chamber 204, in order to surely prevent a leakage of the pressurized oil from the valve chamber 204 into the pressure supply port P even though the pressurized oil supply line on the upstream side of the pressure supply port P causes a little pressure leakage, it is necessary to employ the strong check valve member closing spring 220 of a magnitude sufficient to deform a metal because the check valve member 219 undergoes a metal touching. Therefore, during the pressure supply period for supplying the pressurized oil from the pressure supply port P to the valve chamber 204, since a cracking pressure is so high and a valve opening lift is so small as to provide the pressurized oil with a large pressure loss, a working pressure within the working port A is lowered.

In the case that the control valve assembly 201 for the pressurized oil is employed in a low pressure hydraulic line, a very bad influence is provided by the problem of that working pressure lowering because a percentage of the pressure loss relative to the supplied pressure becomes larger.

SUMMARY OF THE INVENTION

The present invention is directed to solving the problems of the aforementioned respective conventional embodiments and has for its object to extend the sealing service life of the check valve member and to lessen a lowering magnitude of the working pressure within the working port.

For accomplishing the above-mentioned objects, the present invention is characterized in that the aforementioned basic construction is improved as follows.

The interior of the valve chamber is divided into the first chamber on the first end side and the second chamber on the second end side by means of the intermediate partition wall, and the first chamber and the second chamber are intercommunicated with each other by means of a communication hole formed in the intermediate partition wall. The pressure supply port is opened in the first chamber, and the return port and the working port are opened in the second chamber. The check valve member is inserted into the first chamber so as to be brought into contact with the pressure supply valve seat for valve closing through the resilient sealing member. A short-circuit prevention valve seat is formed in the opening edge portion of the communication hole on the side of the second chamber, and a short-circuit prevention valve member is inserted into the second chamber so as to be in series to the return valve member. The short-circuit prevention valve member and the short-circuit prevention valve seat are adapted to be brought into contact with each other for valve closing through hard sealing members. Under the pressure released condition in which the return operation member is operated, the short-circuit prevention valve member is brought into contact with the short-circuit prevention valve seat for valve closing by means of the valve opening member advanced toward the first end side, through the return valve member so as to prevent the pressurized oil within the pressure supply port from leaking from the first chamber to the second chamber.

Incidentally, in the above-mentioned construction, one side portion of the valve chamber may include not only a deep end surface on the first end side of the valve chamber but also a peripheral surface on the second end side of the valve chamber. Namely, instead that the pressure supply port and the first chamber are arranged substantially coaxially with the second chamber, it may be arranged so as to face in such a direction as intersecting the axis of the second chamber.

Since the present invention is constructed as mentioned above, the following advantages are provided.

When the valve assembly is changed over to the pressure released condition, the pushing force of the return operation means is received by means of the short-circuit prevention seat through the short-circuit prevention valve member so as not to act on the resilient sealing member between the check valve member and the pressure supply valve seat. Therefore, even though the number of the operations of the return operation means is accumulated, the resilient state of the resilient sealing member can be kept in a good condition for a long time and the sealing service life of the check valve member becomes longer.

When the valve assembly is changed over to the pressure keeping condition by bringing the valve surface of the check valve member into sealing contact with the pressure supply valve seat, the resilient force of the check valve member closing spring can be small merely enough to cause the resilient deformation of the resilient sealing member such as a rubber and the like. Therefore, under the pressure supply condition, since the check valve member can make the cracking pressure lower and have a large valve opening lift so as to lessen a pressure loss of the pressurized oil, a lowering magnitude of the working pressure within the working port is reduced.

Accordingly, an extension of the sealing service life of the check valve member can coexist with a reduction of the working pressure lowering.

The foregoing and other objects and attendant advantages of the present invention will be readily appreciated as the same becomes better understood by reference to the following detailed description when considered by the accompanying drawings, wherein:

BRIEF DESCRIPTION OF THE DRAWINGS

FIGS. 1 and 2(*a*)–2(*c*) show a first embodiment thereof;

FIG. 1 is a vertical sectional view of a control valve assembly for a pressurized oil;

FIG. 2(*a*) is a view showing a pressure supply condition;

FIG. 2(*b*) is a view showing a pressure keeping condition;

FIG. 2(*c*) is a view showing a pressure released condition;

FIGS. 3, 4 and 5 show a second embodiment, a third embodiment and a fourth embodiment respectively, and are partial views corresponding to FIG. 1;

FIG. 6 shows a fifth embodiment and is a view corresponding to FIG. 1;

DESCRIPTION OF THE PREFERRED EMBODIMENTS

Now, the embodiments of the present invention will be explained with reference to the drawings hereinafter.

First Embodiment

Figure 1:
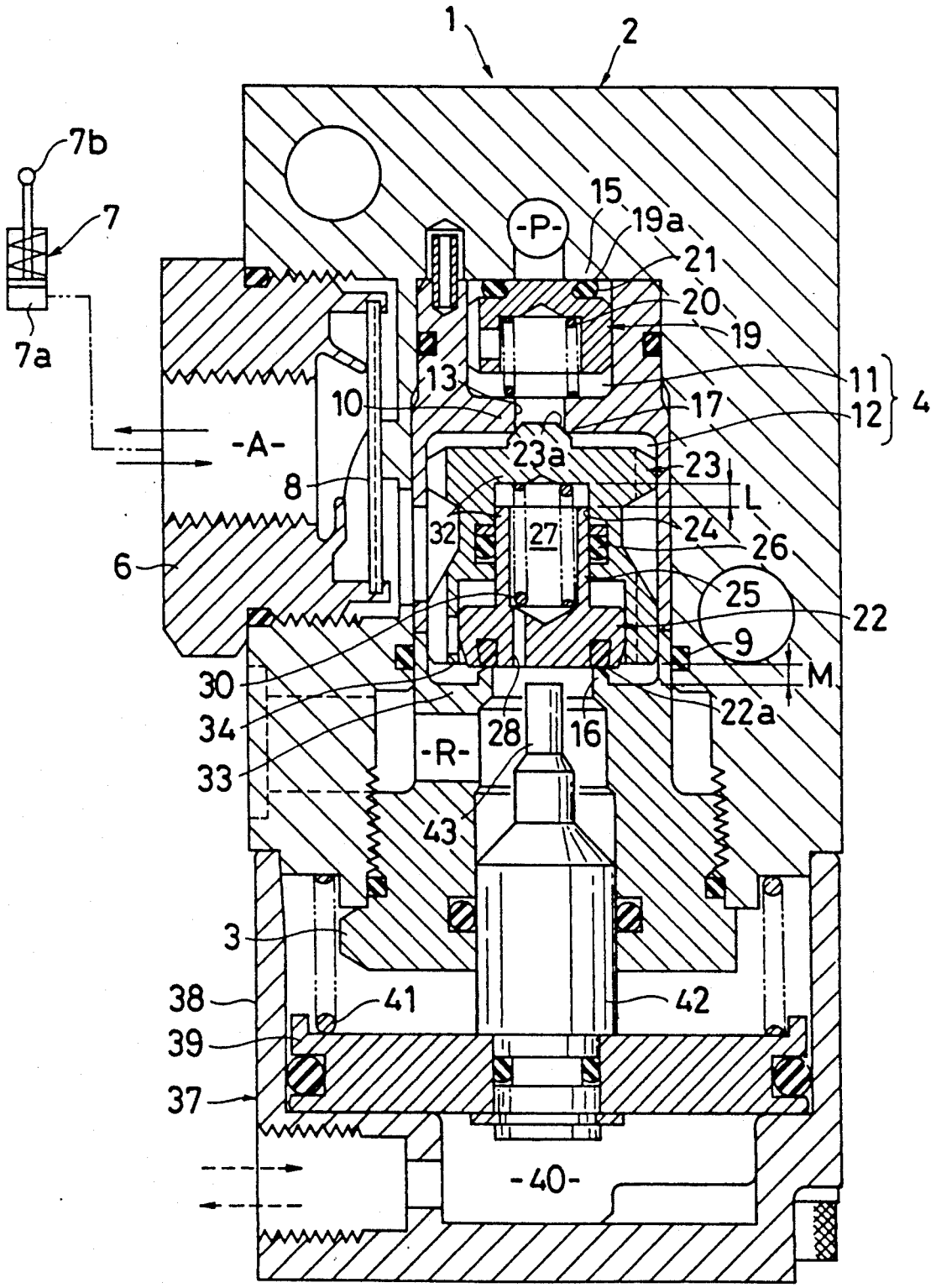
FIGS. 1 through 6 show embodiments of the present invention.
Figure 2C:
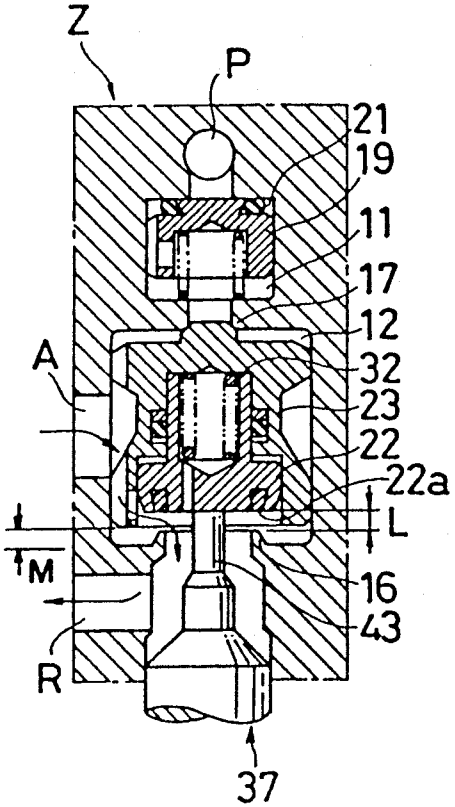
Figure 2B:
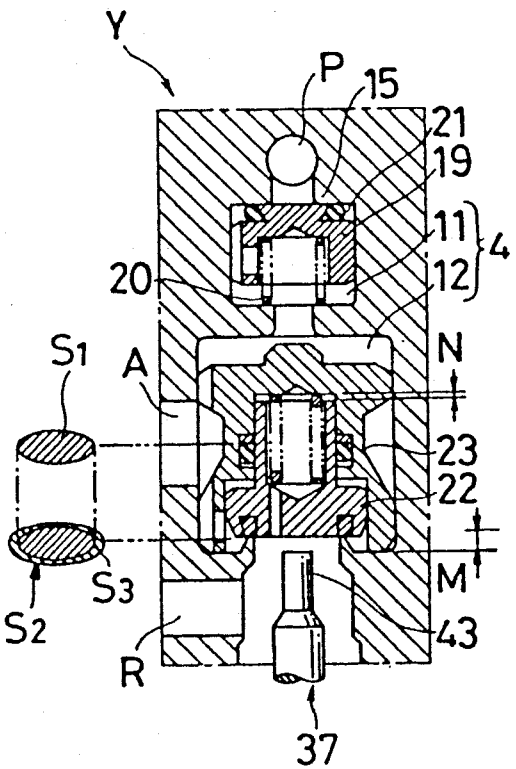
Figure 2A:
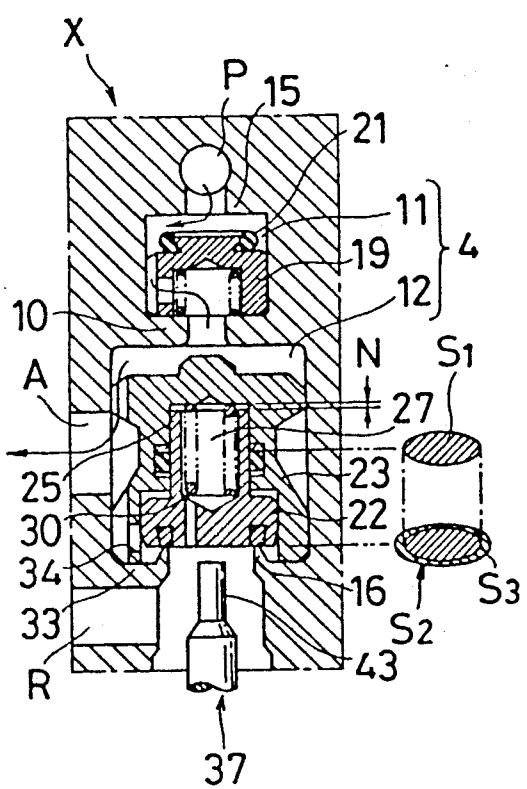

FIGS. 1 and 2(*a*)–2(*c*) show a first embodiment.

In FIG. 1, a valve cover 3 is threadably and oil-tightly secured to the lower portion of a valve box 2 of a control valve assembly 1 for a pressurized oil so that a valve chamber 4 is so formed as to extend vertically along the valve box 2 and the valve cover 3. A pressure supply port P is opened in the upper portion of the valve chamber 4 as the first end side thereof. The pressure supply port P is connected to a delivery port of a hydraulic pump (not illustrated). A return port R is opened in the lower portion of the valve chamber 4 as the second end side thereof. The return port R is connected to an oil tank (not illustrated). A working port A is opened in the peripheral wall of the valve chamber 4 at the location out of both these ports P, R. The working port A is connected to a hydraulic oil chamber 7*a* of a hydraulic cylinder 7 of a single acting spring returned type through a mouth piece 6 threadably secured to the valve box 2. A filter 8 is disposed within the mouth piece 6. Incidentally, the valve cover 3 is separated up and down at the position just above a valve chamber sealing member 9 and is composed of two parts.

The valve chamber 4 is divided to a first chamber 11 and a second chamber 12 by an intermediate partition wall 10 disposed at the upper portion within the valve chamber 4. These first and second chambers 11, 12 are intercommunicated with each other through a communication hole 13 opened in the intermediate partition wall 10.

A pressure supply valve seat 15 is formed in the opening edge portion of the pressure supply port P so as to face the first chamber 11. A return valve seat 16 is formed in the opening edge portion of the return port R so as to face the second chamber 12. Further, a short-circuit prevention valve seat 17 is formed in the opening edge of the communication hole 13 so as to face the second chamber 12.

The check valve member 19 is inserted into the first chamber 11, and the check valve member 19 is resiliently urged to the pressure supply valve seat 15 by means of a check valve member closing spring 20. The valve surface 19*a* of the check valve member 19 is composed of a resilient sealing member 21 made of a rubber. Therefore, the the check valve member closing spring 20 can be such one as having a small resilient force of a magnitude merely sufficient to resiliently deform the rubber.

A return valve member 22 and a short-circuit prevention valve member 23 are inserted into the second chamber 12 in order from below. A piston portion 25 of the return valve member 22 is vertically movably and oil-tightly inserted into a fitting hole 24 concaved in the lower end surface of the short-circuit prevention valve member 23, through an O-ring 26. Thereby, a received pressure removing chamber 27 is disposed between both the valve members 22, 23 in a partitioned state from the second chamber 12. The received pressure removing chamber 27 is formed, as shown in FIG. 2, so that its received pressure removing cross sectional area $S_1$ is smaller than a pressure non-receiving cross sectional area $S_2$ of the return valve seat 16 and is communicated with the return port R through a communication hole 28 formed in the return valve member 22. By means of a return valve member closing spring 30 mounted between both the valve members 22, 23, the return valve member 22 is resiliently urged to the return valve seat 16 for valve closing and the short-circuit prevention valve member 23 is resiliently urged to the short-circuit prevention valve seat 17 for valve closing. The valve surface 22*a* of the return valve member 22 is made of a synthetic resin such as a fluororesin and the like. The valve surface 23*a* of the short-circuit prevention valve member 23 and the short-circuit prevention valve seat 17 are made of a metal so as to be brought into metal-to-metal contact with each other for valve closing.

Between both the valve members 22, 23 a valve opening clearance L and a short-circuit prevention transmitting portion 32 are interposed in the vertical direction. The short-circuit prevention transmitting portion 32 is composed of the upper end portion of the piston portion 25 of the return valve member 22 and the bottom portion of the fitting hole 24.

Further, a stopper portion 33 for limiting the downward valve opening movement of the short-circuit prevention valve member 23 to a valve opening lift M is formed in the lower wall of the interior wall of the second chamber 12. A stopped portion 34 is projected downward from the short-circuit prevention valve member 23 so as to be opposed to the stopper portion 33. The aforementioned valve opening lift M is set in a smaller dimension than the aforementioned valve opening clearance L.

A return operation means 37 is disposed outside the lower end side of the valve chamber 4. The return operation means 37 is of a pneumatic single acting spring returned type. That is, a piston 39 is inserted into a pneumatic cylinder 38 fixedly secured to the lower portion of the valve box 2 so as to be vertically slidable in an air tight manner. An actuation chamber 40 is formed below the piston 39, and a return spring 41 is mounted on the piston 39. A valve opening member 43 for the return valve member 22 is formed in the upper portion of a piston rod 42 projected from the upper side of the piston 39, and the valve opening member 43 is opposed to the return valve member 22 from the side of the return port R.

The aforementioned control valve assembly 1 for the pressurized oil functions as follows.

As shown in FIG. 1, under the no load condition in which a hydraulic pressure doesn't act in both the ports P, A and a pressurized air has been discharged from the actuation chamber 40 of the return operation means 37, the check valve member 19 is closed by a resilient force of the check valve member closing spring 20, and the return valve member 22 and the short-circuit prevention valve member 23 are closed by a resilient force of the return valve member closing spring 30.

When the hydraulic cylinder 7 is so driven as to extend, a pressurized oil is supplied from a hydraulic pump (not illustrated) to the pressure supply port P. Thereupon, firstly the check valve member 19 is a little opened by a hydraulic pressure within the pressure supply port P against a small resilient force of the valve closing spring 20 so as to increase the pressure within the first chamber 11. Then, the short-circuit prevention valve member 23 is opened by the hydraulic pressure within the first chamber 11 against the return valve member closing spring 30.

Thereby, as shown in FIG. 2(*a*), the pressurized oil is supplied from the pressure supply port P to the working port A so as to extend the hydraulic cylinder 7. Under the pressure supply condition X, the return valve member 22 is brought into contact with the return valve seat 16 for valve closing by means of a resultant force of the resilient force of the return valve member closing spring 30 and the interior pressure of the second chamber 12. The interior pressure of the second chamber 12 acts on a valve closing pressure receiving area $S_3$ as an annular area obtained by subtracting the received pressure removing cross sectional area $S_1$ of the received pressure removing chamber 27 from the pressure non-receiving cross sectional area $S_2$ of the return valve seat 16 so as to apply a downward valve closing force onto the return valve member 22.

Figure 8:
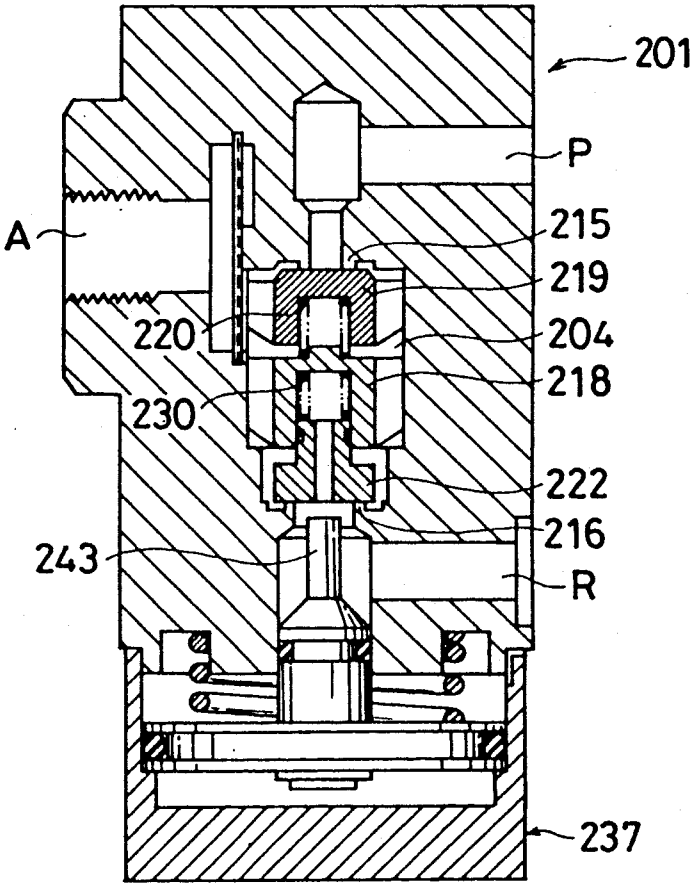
FIG. 8 PRIOR ART
FIG. 8 shows a second conventional embodiment and is a view corresponding to FIG. 1.
Figure 7:
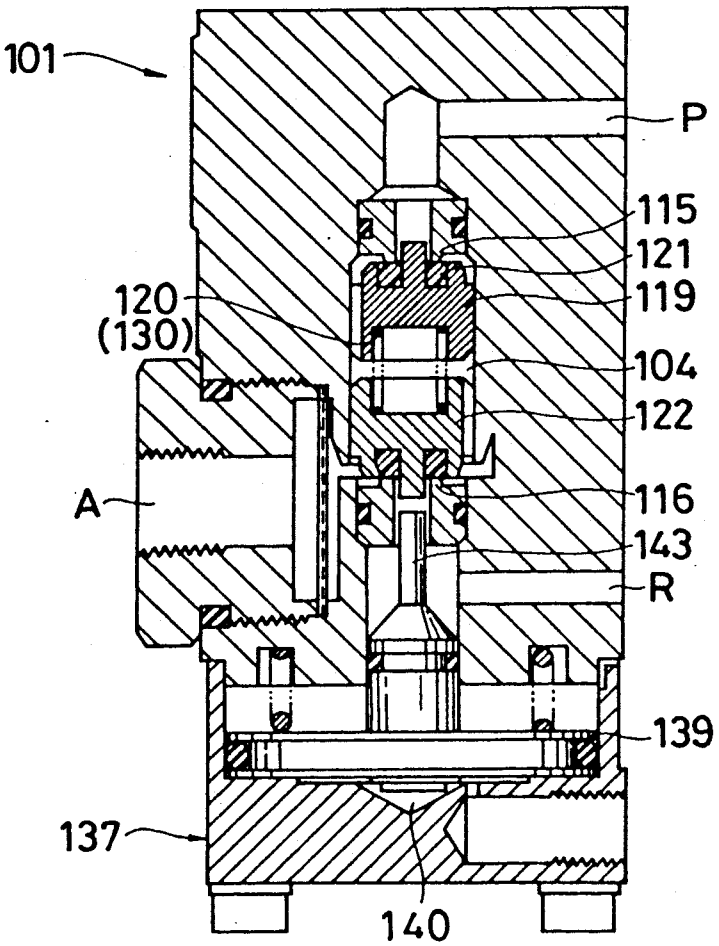
FIG. 7 PRIOR ART
FIG. 7 shows a first conventional embodiment and is a view corresponding to FIG. 1.

After the short-circuit prevention valve member 23 is once closed, the downward received pressure produced by the interior pressure of the second chamber 12 corresponding to the received pressure removing cross sectional area $S_1$ is applied thereto so as to keep its valve opened condition. Therefore, even though the flow of the pressurized oil entering the second chamber 12 from the pressure supply port P through the first chamber 11 is varied by a pulsation of a delivery quantity of the hydraulic pump and the like, the short-circuit prevention valve member 23 doesn't cause a chattering differently from the check valve member 119 of the first conventional embodiment (refer to FIG. 7) and the check valve member 219 of the second conventional embodiment (refer to FIG. 8). Resultantly, a generation of noises can be prevented and a damage of the valve surface 23*a* of the short-circuit prevention valve member 23 can be prevented. Further, since the short-circuit prevention valve member 23 is kept in the fully opened condition during supply of the pressure, a flow resistance of the pressurized oil can be small and an extending speed of the hydraulic cylinder 7 is high.

Further, since the stopped portion 34 is adapted to be received by the stopper portion 33, the valve opening movement of the short-circuit prevention valve member 23 is limited to the aforementioned valve opening lift M. Thereby, between the piston portion 25 of the return valve member 22 and the short-circuit prevention valve member 23 there is provided a contact prevention clearance N effective during supply of the pressure, formed in a dimension obtained by subtracting the valve opening lift M from the valve opening clearance L.

Under the pressure supply condition X as shown in FIG. 2(*a*), when the load imposed to an output portion 7*b* of the hydraulic cylinder 7 is increased as the hydraulic cylinder 7 extends, the pressures within the working chamber 7*a* and the working port A are increased. Accompanying therewith, when the pressures within the second chamber 12 and the first chamber 11 are increased to become substantially equal to the pressure within the pressure supply port P, as shown in FIG. 2(*b*), the check valve member 19 is automatically brought into contact with the pressure supply valve seat 15 for valve closing by means of the resilient force of the check valve member closing spring 20. Thereby, though a little pressure leak is caused on the side of the pressure supply port P, the lowering of the interior pressure of the valve chamber 4 is surely prevented so as to attain the pressure keeping condition Y. Under this pressure keeping condition Y, since the contact prevention clearance N is provided between the return valve member 22 and the short-circuit prevention valve member 23, only the valve closing force acting on the annular valve closing pressure receiving area $S_3$ is applied to the return valve member 22. Thereby, a damage of the synthetic resin valve surface 22*a* of the return valve member 22 is prevented.

On one hand, when contracting the hydraulic cylinder 7, the piston 39 is driven upward against the resilient force of the return spring 41 by supplying the compressed air to the actuation chamber 40 of the return operation means 37. Thereupon, as shown in FIG. 2(*c*), the return valve member 22 is pushed and opened by means of the valve opening member 43 so that the pressurized oils within the working port A and the second chamber 12 are discharged to the return port R as well as the short-circuit prevention valve member 23 is brought into contact with the short-circuit prevention valve seat 17 for valve closing by means of the valve opening member 43 through the return valve member 22 and the short-circuit prevention transmitting portion 32 in order. Thereby, the pressurized oil within the pressure supply port P is prevented from leaking from the first chamber 11 into the second chamber 12.

In the above-mentioned case, the operation force required for opening the return valve member 22 can be small only enough to surpass the interior pressure acting on the annular valve closing pressure receiving area $S_3$.

Therefore, the return operation means 37 can be one requiring a light operation force, and the diameter of the pneumatic cylinder 38 can be made small. Further, during the pressure releasing operation of the return operation means 37, since the valve surface 22*a* having a large area, of the return valve member 22 is soon separated from the return valve seat 16 by means of the valve opening member 43, a passage having a large cross-sectional area can be provided and the flow resistance can be small. Resultantly, since the pressurized oil within the second chamber 12 is allowed to flow out in a large quantity to the return port R, the returning time of the hydraulic cylinder 7 can be made short though the hydraulic cylinder 7 is of a spring returned type.

In the initial stage of the pressure releasing operation, the compressed air entered the pneumatic actuation chamber 40 reaches a predetermined pressure with repeating pressure pulsations similarly to the above-mentioned conventional embodiments. Even though the short-circuit prevention valve member 23 repeats its opening and closing operations relative to the short-circuit prevention valve seat 17 during these pressure pulsations, the valve surface 23*a* of the short-circuit prevention valve member 23 and the short-circuit prevention valve seat 17 are hardly damaged because of their metal-to-metal contact construction. Even though they are damaged due to an accumulated number of the returning operations, a practical disadvantage is not provided because the prevention of the pressure leakage under the pressure keeping condition shown in FIG. 2(*b*) is accomplished by the check valve member 19 differently from the respective conventional embodiments.

By the way, when the compressed air is discharged from the actuation chamber 40 of the return operation means 37 after the completion of the contraction of the hydraulic cylinder 7, the valve opening member 43 is retreated downward through the piston 39 and the piston rod 42 so as to be changed over to the pressure keeping condition X shown in FIG. 2(*a*).

FIGS. 3 through 6 show other embodiments respectively and their constructions different from the first embodiment will be explained. Incidentally, component members having the same constructions as those of the first embodiment are designated with the same symbols.

Second Embodiment

Figure 3:
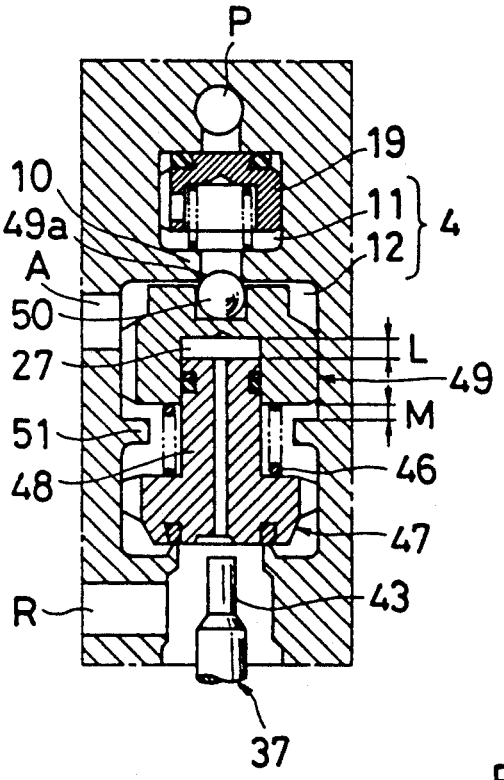

FIG. 3 shows a second embodiment.

A return valve member closing spring 46 is mounted to the outer periphery of a piston portion 48 of a return valve member 47 between the return valve member 47 and the short-circuit prevention valve member 49.

A valve surface 49*a* of the short-circuit prevention valve 49 is formed by an outer peripheral surface of a metallic spherical body 50 fitted in the upper portion of the short-circuit prevention valve member 49.

Further, a stopper portion 51 for limiting the valve opening movement of the short-circuit prevention valve member 49 to the valve opening lift M is projected from the peripheral wall of the inner wall of the second chamber 12.

Third Embodiment

Figure 4:
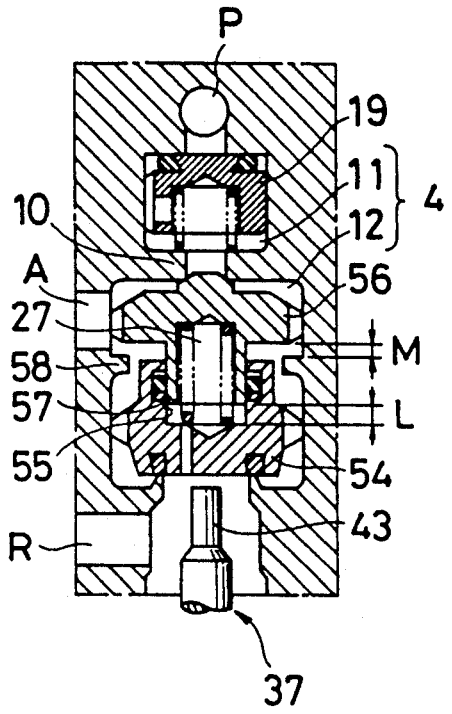

FIG. 4 shows a third embodiment.

A fitting hole 55 is formed in a concaved shape in the upper end surface of the return valve member 54, and a piston portion 57 is projected downward from a short-circuit prevention valve member 56.

Incidentally, a stopper portion 58 of the short-circuit prevention valve member 56 is projected from the peripheral wall of the second chamber 12 similarly to the embodiment shown in FIG. 3.

Fourth Embodiment

Figure 5:
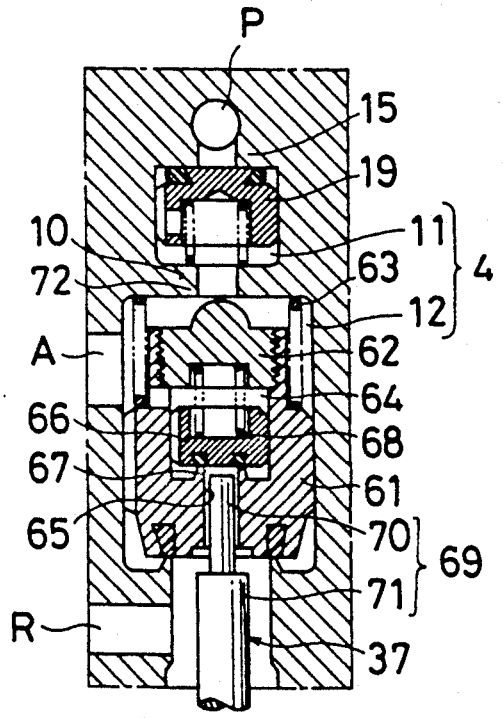

FIG. 5 shows a fourth embodiment.

In this case, both valve members 61, 62 are formed in an integrated manner by threadably securing the short-circuit prevention valve member 62 to the upper portion of the return valve member 61. A return valve member closing spring 63 is mounted between the return valve member 61 and the upper wall of the second chamber 12. A pressure releasing valve chamber 64 communicating with the second chamber 12 is formed within both the valve members 61, 62, and the pressure releasing valve chamber 64 and the return port R are intercommunicated with each other by means of a pressure releasing hole 65. A pressure releasing valve member 66 inserted into the pressure releasing valve chamber 64 is brought into contact with a pressure releasing valve seat 67 formed in the upper periphery of the pressure releasing hole 65 for valve closing by means of a pressure releasing valve member closing spring 68. A valve opening member 69 of the return operation means 37 is composed of a pressure releasing valve opening member 70 and a return valve opening member 71 arranged in order from above.

At the time of pressure releasing operation carried out by the return operation means 37, after the pressure within the second chamber 12 is released by opening the pressure releasing valve member 66 by means of the pressure releasing valve opening member 70, the return valve member 61 is adapted to be opened with a light force by means of the return valve opening member 71 and the short-circuit prevention valve member 62 is adapted to be brought into contact with the short-circuit prevention valve seat 72 for valve closing through the return valve member 61.

Incidentally, though the pressure supplying port P and the first chamber 11 are arranged substantially coaxially with the second chamber 12 in the above-mentioned respective embodiments, they may be arranged in such a direction as intersecting the axis of the second chamber 12.

Fifth Embodiment

Figure 6:
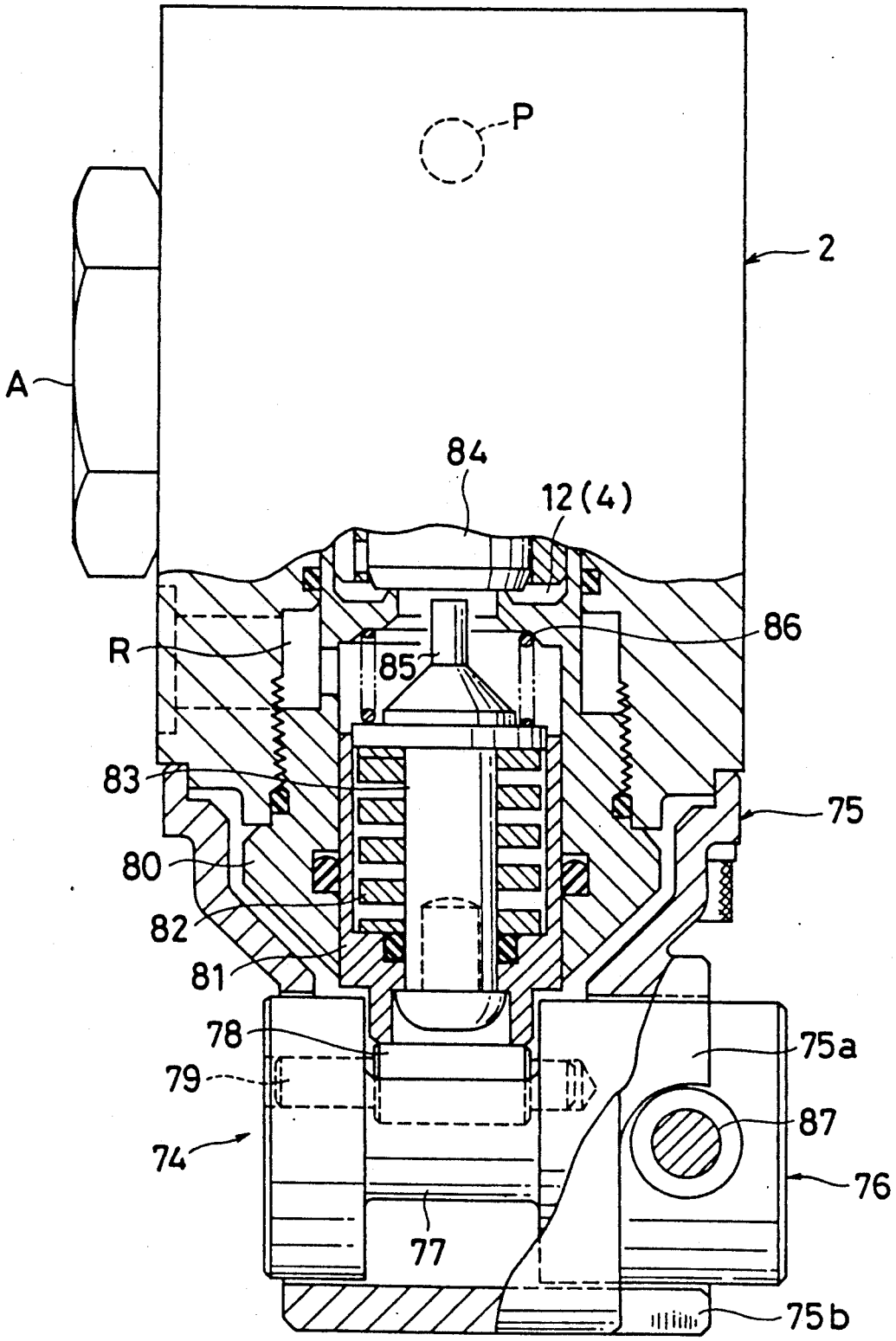

FIG. 6 shows a fifth embodiment.

This embodiment employs a return operation means 74 constructed as a maneuvering type and has the following construction.

A pivot shaft 76 is rotatably supported by the lower portion of a bracket 75 fixedly secured to the valve box 2. The central portion of the pivot shaft 76 in the right and left direction has a reduced diameter, and a pushing roller 78 is supported by a pin 79 at an eccentric position outside the reduced diameter portion 77. On one hand, a pushing cylinder 81 is inserted into a valve cover 80 so as to be opposed to the pushing roller 78. A valve opening actuation rod 83 is resiliently urged upward within the cylindrical hole of the pushing cylinder 81 through a pushing spring 82. A valve opening member 85 for a return valve member 84 is formed in the upper portion of the rod 83, and the rod 83 is resiliently urged downward by means of a return spring 86.

This return operation means 74 operates as follows.

As illustrated, under such a condition as having changed over an actuation lever 87 fixedly secured to the right side of the pivot shaft 76 to an upward rotated position in which the lever 87 is received by an upper stopper 75*a* of the bracket 75, the pushing roller 78 is located on the lower side and both the rod 83 and the pushing cylinder 81 are retreated downward by means of the return spring 86.

When the valve assembly is changed over to the pressure releasing, the aforementioned operation lever 87 is swung downward so as to be changed over to a downward rotated position in which the lever 87 is received by a lower stopper 75*b* of the bracket 75. Thereupon, the pivot shaft 76 rotates and the pushing roller 78 moves to the upper position so as to advance the rod 83 upward through the pushing cylinder 81 and the pushing spring 82 in order and then to open the return valve 84.

Having described specific preferred embodiments of the invention with reference to the accompanying drawings, it will be appreciated that the present invention is not limited to those specific embodiments, and that various changes and modifications can be effected therein by one of ordinary skill in the art without departing from the spirit or scope of the invention as defined by the appended claims.

What is claimed is:

1. A control valve assembly for a pressurized oil, including a valve chamber (4) having a first end side and a second end side opposed to each other; a pressure supply port (P) opened to the first end side space of the valve chamber (4); a return port (R) opened to the second end side space of the valve chamber (4); a working port (A) opened to the valve chamber (4) at a location out of both the ports (P), (R); a pressure supply valve seat (15) formed in the opening edge portion of the pressure supply port (P); a return valve seat (16) formed in the opening edge portion of the return port (R); a check valve member (19) inserted into the first end side of the valve chamber (4) and resiliently urged to the pressure supply valve seat (15) for valve closing by means of a check valve member closing spring (20); a return valve member (22) inserted into the second end side of the valve chamber (4) and resiliently urged to the return valve seat (16) by means of a return valve member closing spring (30); and a return operation means (37) provided with a valve opening member (43) adapted to push the return valve member (22) toward the first end side, characterized in that said valve chamber (4) is divided into a first chamber (11) on the first end side and a second chamber (12) on the second end side by means of an intermediate partition wall (10), said intermediate partition wall (10) has a communication hole (13) for intercommunicating the first chamber (11) and the second chamber (12) with each other, that said pressure supply port (P) is opened to the first chamber (11), and said return port (R) and said working port (A) are opened to the second chamber (12), that said check valve member (19) is inserted into the first chamber (11) and adapted to be brought into contact with the pressure supply valve seat (15) for valve closing through a resilient sealing member (21), that a short-circuit prevention valve seat (17) is formed in the opening edge portion of said communication hole (13) on the side of the second chamber (12), that a short-circuit prevention valve (23) is inserted into said second chamber (12) in series to said return valve member (22) and adapted to be brought into contact with the short-circuit prevention valve seat (17) for valve closing through hard sealing members, and that under a pressure releasing condition (Z) in which said return operation means (37) is operated, said short-circuit prevention valve member (23) is adapted to be brought into contact with the short-circuit prevention valve seat (17) for valve closing through the return valve member (22) by means of the valve opening member (43) advanced toward the first end side, and thereby the pressurized oil within the pressure supply port (P) is prevented from leaking from the first chamber (11) to the second chamber (12).

2. A control valve assembly for a pressurized oil as defined in claim 1, wherein said check valve member (19) is provided with a valve surface (19*a*), and the valve surface (19*a*) is composed of said resilient sealing member (21).

3. A control valve assembly for a pressurized oil as defined in claim 1 or claim 2, wherein said return valve member (22) is provided with a valve surface (22*a*), and said valve surface (22*a*) is composed of another resilient sealing member.

4. A control valve assembly for a pressurized oil as defined in claims 1 or 2, wherein said return valve member (22) and said short-circuit prevention valve member (23) are separately formed, and between both these valve members (22)(23) there are provided a valve opening clearance (L) and a short-circuit prevention transmitting portion (32), and under the pressure released condition (Z) in which said return operation means (37) is operated, said valve opening member (43) is adapted to bring the short-circuit prevention valve member (23) into contact with the short-circuit prevention valve seat (17) for valve closing through the return valve member (22) and the short-circuit prevention transmitting portion (32) in order.

5. A control valve assembly for a pressurized oil as defined in claim 4, wherein a fitting hole (24) is formed in a concaved shape in one of the opposed end surfaces of both said return valve member (22) and said shortcircuit prevention valve member (23), the other valve member (22) is movably and oil-tightly inserted into the fitting hole (24), and a received pressure removing chamber (27) is disposed between both said valve members (22)(23) in a partioned manner from the second chamber (12), and said received pressure removing chamber (27) has its received pressure removing cross-sectional area ($S_1$) made smaller than a pressure non-receiving cross-sectional area ($S_2$) defined in the return valve seat (16) and is communicated with the return port (R) through the communication hole (28) formed in the return valve member (22).

6. A control valve assembly for a pressurized oil as defined in claim 5, wherein said second chamber (12) is provided with a stopper portion (33) which limits the valve opening movement of the short-circuit prevention valve member (23) to a valve opening lift (M), and this valve opening lift (M) is set in a smaller dimension than said valve opening clearance (L).

7. A control valve assembly for a pressurized oil as defined in claim 6, wherein said return valve member (22) is provided with a valve surface (22*a*), and said valve surface (22*a*) is composed of another resilient sealing member.

8. A control valve assembly for a pressurized oil as defined in claim 6, wherein said short-circuit prevention valve member (23) is resiliently urged to the short-circuit prevention valve seat (17) for valve closing by means of a return valve member closing spring (30).

9. A control valve assembly for a pressurized oil as defined in claim 8, wherein said return valve member (22) is provided with a valve surface (22*a*), and said valve surface (22*a*) is composed of another resilient sealing member.

10. A control valve assembly for a pressurized oil as defined in claim 5, wherein said return valve member (22) is provided with a valve surface (22), and said valve surface (22*a*) is composed of another resilient sealing member.

11. A control valve assembly for a pressurized oil as defined in claim 5, where said short-circuit prevention valve member (23) is resiliently urged to the short-circuit prevention valve seat (17) for valve closing by means of a return valve member closing spring (30).

12. A control valve assembly for a pressurized oil as defined in claim 11, wherein said return valve member (22) is provided with a valve surface (22*a*) is composed of another resilient sealing member.

13. A control valve assembly for a pressurized oil as defined in claim 4, wherein said short-circuit prevention valve member (23) is resiliently urged to the short-circuit prevention valve seat (17) for valve closing by means of a return valve member closing spring (30).

14. A control valve assembly for a pressurized oil as defined in claim 13, wherein said return valve member (22) is provided with a valve surface (22*a*), and said valve surface (22*a*) is composed of another resilient sealing member.

15. A control valve assembly for a pressurized oil as defined in claim 4, wherein said return valve member (22) is provided with a valve surface (22*a*), and said valve surface (22*a*) is composed of another resilient sealing member.

* * * * *